United States Patent [19]

Kobryn et al.

[11] Patent Number: 4,852,481

[45] Date of Patent: Aug. 1, 1989

[54] PRINT HAMMER MECHANISM

[75] Inventors: Ronald J. Kobryn, Longwood; Justin Gaskins, Deltona, both of Fla.

[73] Assignees: L. James Hubbard; Virginia M. Hubbard, both of P.R.

[21] Appl. No.: 219,494

[22] Filed: Jul. 14, 1988

[51] Int. Cl.[4] ..... B41J 9/12; B41J 9/38

[52] U.S. Cl. ..... 101/93.48; 101/93.29; 400/157.2

[58] Field of Search ..... 101/93.48, 93.29, 93.30, 101/93.31, 93.32, 93.33, 93.34, 93.28; 400/157.2, 155.1

[56] References Cited

U.S. PATENT DOCUMENTS

| | | | |
|---|---|---|---|
| 3,266,419 | 8/1966 | Erpel et al. | 400/157.2 |
| 3,335,659 | 8/1967 | Schacht et al. . | |
| 3,477,365 | 11/1969 | Nyman . | |
| 3,504,623 | 4/1968 | Staller | 101/93.33 |
| 3,543,906 | 12/1970 | Hladky . | |
| 3,705,370 | 12/1972 | Chai et al. . | |
| 3,741,113 | 6/1973 | Mako et al. . | |
| 3,748,613 | 7/1983 | Venker | 101/93.29 |
| 4,371,857 | 2/1983 | Bohg et al. . | |
| 4,440,079 | 4/1984 | Dayger et al. | 101/93.29 |
| 4,522,122 | 6/1985 | Mazumder . | |
| 4,523,867 | 6/1985 | Berrey et al. . | |
| 4,687,354 | 8/1987 | Tanaka | 101/93.48 |
| 4,736,679 | 4/1988 | Kobryn | 101/111 |

FOREIGN PATENT DOCUMENTS

| | | | |
|---|---|---|---|
| 0113006 | 7/1984 | European Pat. Off. | 400/157.2 |
| 2907456 | 9/1980 | Fed. Rep. of Germany | 101/93.34 |

OTHER PUBLICATIONS

"Linear Print Hammer Actuator", IBM Technical Disclosure Bulletin, vol. 29, No. 2, Jul. 1986, pp. 816–820.

*Primary Examiner*—Paul T. Sewell

*Attorney, Agent, or Firm*—Martin LuKacher

[57] ABSTRACT

A print hammer mechanism for use in an impact printer such as a band printer or other printer which has printing elements which are impacted to make impressions on paper or other record medium. The hammer of the mechanism is impacted by dual armatures in forward motion toward the paper and return motion away from the paper so that the hammer is positively driven and does not depend upon the bounce back of the hammer from the paper or need a return spring on the hammer. This reduces the time for each hammer stroke and increases printing speed (characters per second). The armatures are normally decoupled from the hammmer and strike the hammer only after accelerating sufficiently to transfer sufficient speed to the hammer upon impact therewith. Springs are used to bias the hammer to a home position in the return direction and to maintain the armatures against a stop spaced from the hammer so that the armatures are normally decoupled from the hammer. The spring forces are light; forward and return hammer drive being provided by the armatures. A magnetic field structure for independently actuating each armature can be used for actuating the hammer in timed relationship with printing operations.

20 Claims, 4 Drawing Sheets

PRINT HAMMER MECHANISM

The present invention relates to print hammer mechanisms, and particularly to an improved assembly including a print hammer and actuators for driving the hammer into impacting relationship with a printing element for printing on a record medium and also for driving the hammer in an opposite or return direction clear of the printing element so as to allow different printing elements to move into printing position, minimizing the time required for the stroke of the hammer from the forward and return directions so as to increase printing speed.

The invention is especially suitable for use in band printers in which a band carries the printing elements so as to present different elements for impact by the hammer or hammers of a print hammer mechanism. The invention may also be used in other printers utilizing printing elements such as daisy wheel, thimble or ball-type elements.

It is the principal object of this invention to provide an improved print hammer mechanism designed to reduce the limitation on printing speed due to the time required for the hammer of the mechanism to execute its stroke.

It is a feature of the invention to provide improvements in reliability by avoiding reliance on springs to return the hammer of a print hammer mechanism after the hammer strikes the printing element.

It is a further object of the present invention to provide an improved print hammer mechanism in which the hammer is positively driven both in the forward and return direction by the hammer actuator but is not limited in operating speed by hysteresis effects which reduce the operating speed of the mechanism by imposing time requirements to develop forces in the return direction.

Reference may be had to U.S. Pat. No. 4,736,679 issued Apr. 12, 1988 to the inventor hereof for a band printer which uses a print hammer mechanism wherein an armature impacts the print hammer and drives it on a forward stroke into impacting relationship with a printing element which prints characters or other impressions on a paper record medium. The print hammer mechanism relies upon return springs for moving the hammers in the return direction after bouncing back on impact with the flexible printing elements. The armatures are electromagnetically actuated and also operate against springs which bias them to their return position. The magnetic forces on the armature and the impact force in the forward direction on the hammer are opposed by the return springs. It is desirable to reduce these opposing forces thereby reducing the required magnetic actuating forces and the time required to execute the forward stroke of the hammer.

It has been proposed to provide actuators which drive the hammer in both the forward and return direction. Such actuators have direct coupling between the electromagnetic field structure and the hammer. They are subject to hysteresis effects which increase the time required to accelerate the hammer and the linkage attached thereto between the forward and return portion of the stroke thereby limiting the speed of the printing element carrier such as the band, daisy wheel or the like, and reducing overall printing speed.

Briefly described, a print hammer mechanism in accordance with the invention uses a print hammer which is moveable toward and away from a printing position. The hammer is driven by first and second armatures which are independently moveable and disposed for engagement with the hammer to drive the hammer in the forward and return direction. The armatures are mounted in non-interfering relationship with the hammer until engagement therewith. This enables the armatures to accelerate through a sufficient distance prior to contacting the hammer which minimizes the time for execution of the forward and return strokes. The armatures and the hammer may be biased by weak return springs to a home position. These springs do not significantly oppose the driving force developed by the armatures so as to reduce the travel time of the hammer under the forces applied by the armatures. Also, since reliance is not placed on springs the reliability of the mechanism is enhanced over mechanisms which do rely on springs to develop forces on the hammer for returning it to a home position.

The foregoing and other objects, features and advantages of the invention will become more apparent from a reading of the following description in connection with the accompanying drawings in which.

Figure 1:
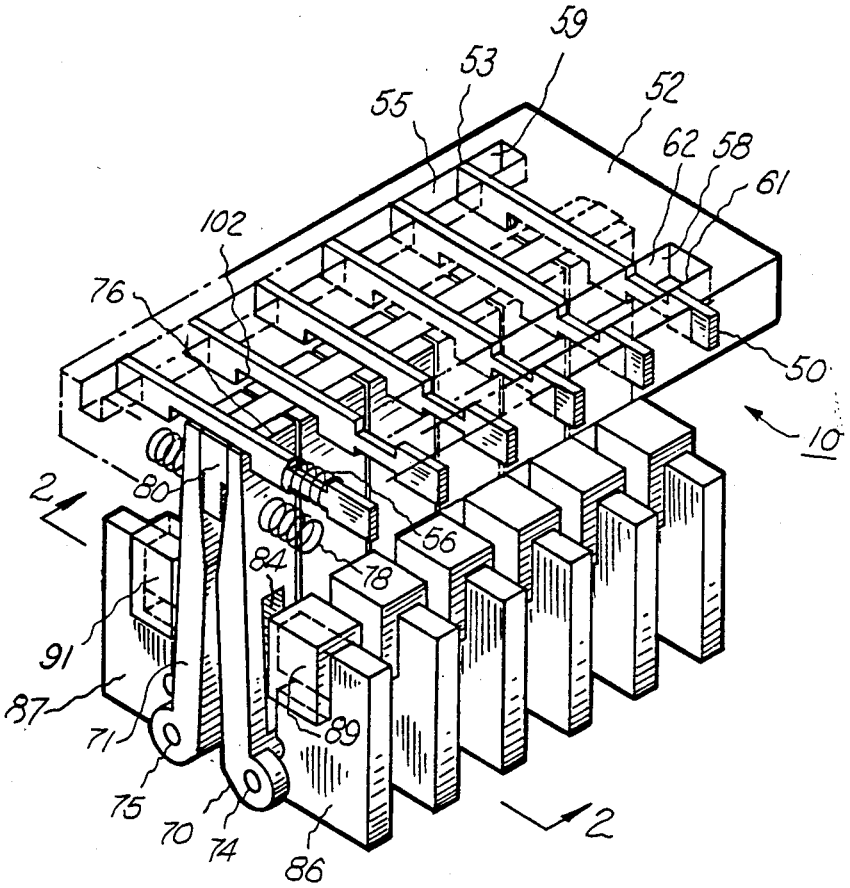
FIG. 1 is a diagrammatic perspective view schematically illustrating a multiple print hammer mechanism embodying the invention.
Figure 2:
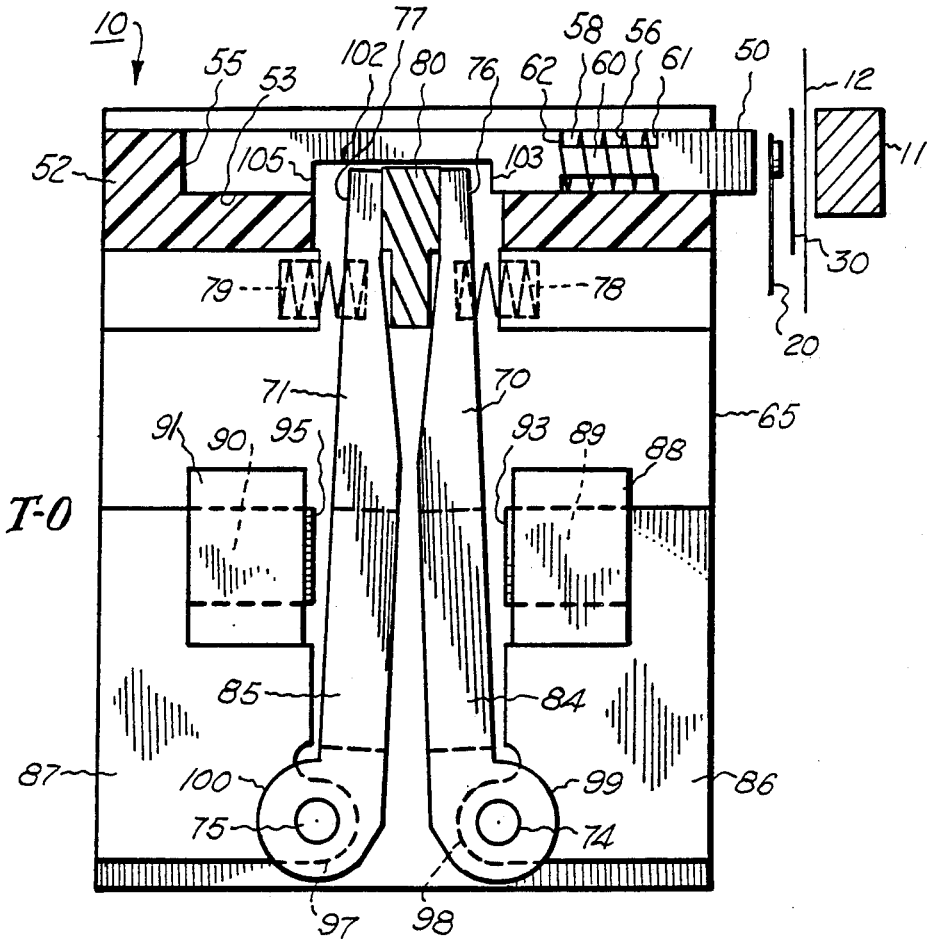
FIG. 2 is a diagramatic elevational view taken generally along the line 2—2 in FIG. 1.

Referring to FIGS. 1 and 2 there shown the platen 11, record medium paper 12, ribbon 30 and printing element 20 of the print band of a band printer which incorporates a print hammer mechanism 10 embodying the invention. Reference may be had to the above-identified U.S. Pat. No. 4,736,679 for further information respecting the elements 10, 12, 30 and 20. The mechanism 10 has a plurality of bars which provide the hammers 50 thereof. While six hammers 50 are shown, it will be understood that the mechanism 10 may have one or more hammers. A hammer housing 52 supports the hammers 50 in slots 53 therein for reciprocating motion therein. The forward ends of the slots 53 which face the printing elements 20 are open so that the hammers can project therethrough. The slots 53 have rear end surfaces 55 which provide stops and index, and define the home position of, the hammers at the end of the return stroke in a direction away from the printing elements 20.

The hammer housing 52 has a forward slot 58 which is perpendicular to the slots 53 in which the hammers 50 are mounted. There is another slot 59 in the housing 52 which is parallel to and rear of the slot 58 and provides access to the rear end surface 55 which indexes the hammers 50 at their return position. The hammers 50 have a neck 60 of reduced height and of a length approximately equal to the length (in the direction of hammer travel) of the forward slot 58. Springs 56 are located around the necks 60 in the slot 58. The ends of the springs bear against forward and rear walls 61 and 62 of the slot 58. The springs 56 bias the hammers 50 against the home position indexing surfaces 55.

The assembly of the hammers 50 and housing 52 are disposed on a support body 65 (shown in FIG. 2 but not shown in FIG. 1 to simplify the illustration). This body 65 provides a mounting for a plurality of spaced magnet structures or cores 86 and 87, one pair of which is provided for each of the hammers. These cores have pole pieces 89 and 90 around which coils 88 and 91 are wound. These coils are connected to sources of drive current which preferably provide pulses of current in timed relationship for actuating the hammers 50. The cores 86 and 87 and the coils 88 and 91 provide magnetic actuating means for actuating armatures 70 and 71. Armature 70 will be referred to as the print armature and the armature 71 as the return armature. Each armature is pivotally mounted on an axis 74 and 75 which extends perpendicular to the path of travel of the hammers 50. The armatures are preferably bars having magnetic material, at least in the sections thereof facing the ends 93 and 95 of the pole pieces 89 and 90.

The pivotal mounting is, by pins to ears 97 and 98 which project toward each other from the cores 86 and 87 near the bottom of the cores. The pins extend from the armatures 70 and 71 into holes in the cores. Other pivotal connections can be used. The pins may extend between pairs of ears 99 and 100 on each of the armatures 70 and 71 which overlap the ears 97 and 98 on the cores 86 and 87 and capture the ears 97 and 98 when pinned thereto.

Instead being made entirely of magnetic material the armatures 70 and 71 may be made of light weight plastic material, such as polycarbonate, with inserts 84 and 85 of magnetic material which complete a magnetic circuit between the pole ends 93 and 95 and the rest of the cores 86 and 87.

The slots 53 in the hammer housing 52 and therefore the spacing of the hammers from each other may be equal to or slightly wider than the width of the armatures 70 and 71. The armatures having a width much larger than the width of the hammers 50. The assembly of hammer housing 52 and hammers 50 may be moveable in a direction along the path of the band carrying the printing elements 20 (perpendicular to the direction of travel of the hammers 50) so as to enable printing of dot elements as well as characters. A translating mechanism, such as a belt connected to the housing 52 may be used. Such a translating mechanism is described in the above-referenced U.S. Pat. No. 4,736,679. In the event that the hammer or hammer assembly is not moveable along the print band, the housing 52 may be connected to the support body 65 or be an integral part thereof.

The hammers 50 have slots 102 with end walls 103 and 105 which provide impact surfaces for the print armature 70 and the return armature 71, respectively. The armatures 70 and 71 extend into the slots 102 and their upper ends are in the slots. A stop bar 80, which is connected to the support body 65 at the ends thereof, provides a rest or home position for the armatures. Springs 78 and 79 bias the armatures (rotate them around their axes 74 and 75) against the stop 80. When disposed against the stop 80, the armatures are decoupled from the hammers because there is free space between the armatures and the impact surfaces 103 and 105. Therefore, the hammers 50 are free to move without interference and are restrained only by the bias of their return springs 56. The relative dimensions of the armature ends and the location of the print armature impact surface 76 and the return armature impact surface 77 to the surfaces 103 and 105 provides for freedom of movement of the hammer with respect to armatures over the working distance of the hammer which is its total travel in the forward direction to a position where the hammers impact the printing elements 20 plus a distance to accommodate acceleration in the forward or print direction and bounce off the printing elements 20, ribbon 30 and paper 12 when traveling in the return direction. In effect the armatures are decoupled from the hammer except when contacting and driving the hammer. The return springs 78 and 79 as well as the hammer against the rear end surface 55 return springs 56 are very weak springs which serve merely to maintain the hammer and armatures 70 and 71 against the stop 80 and between actuations.

After a pulse of current is applied the coils (the coil 88 or print coil for printing and the coil 91 or return coil to return the hammer to the home position), the distances (spacing) between the impacting surfaces 76 and 103 and 77 and 105 enable the acceleration of the armatures to develop speed and force sufficient to drive the hammer in the forward direction for printing and then in the return direction in time sequence. The mass of the armatures 70 and 71 is in each case much greater than the mass of the hammers 50 which they impact. In addition, the springs are weak. Therefore, acceleration is rapid and the time for movement of the hammers into impacting relationship with the printing elements is minimized.

Figure 3A:
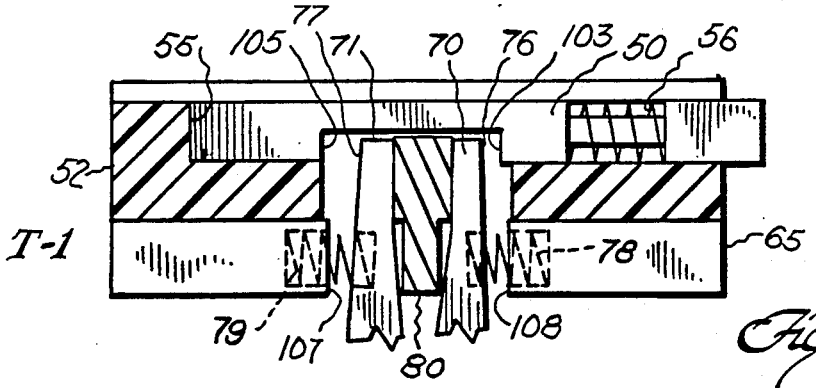
FIGS. 3*a* to 3*h* are fragmentary views similar to FIG. 2 illustrating the mechanism at eight successive points in time in the course of executing a stroke.
Figure 3B:
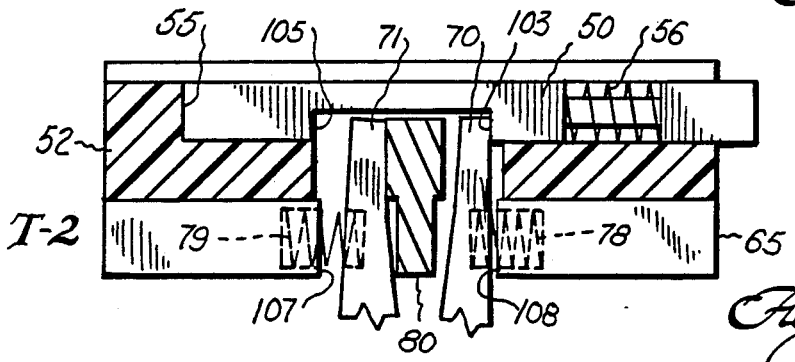
Figure 3C:
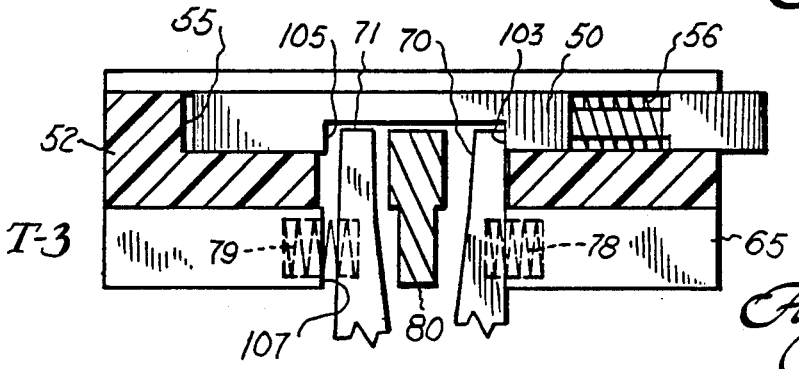

The operation of the herein illustrated print hammer mechanism will be more apparent from FIGS. 3A through 3H which shows the mechanism in positions during a cycle at successive intervals of time indicated as T1 through T8. The start or relaxed position prior to a print and return cycle, at time T0 is shown in FIG. 2. At time T0 the mechanism is at rest and a current pulse to command a print operation is applied to the new print coil 88. By time T1 the magnetic flux is building up in the core, but the magnetic force is not sufficient to attract the print armature 70 and the position of the components is not changed. Between time T1 and T2 (T2 being shown in FIG. 3B) the print armature 70 has accelerated to a position where contact is made between the surfaces 76 and 103 (the forward end wall of the slot 102—See FIG. 2). The hammer 50 then begins its driven flight in the forward direction. The print armature 70 continues to drive the hammer in the forward direction until the armature contacts a stop indicated at 108 which is part of the support body 65. Contact with the stop occurs at time T3 as shown in FIG. 3C. The return pulse of current is applied, before the termination of the forward pulse, to the return coil 91, and the return armature 71 begins moving away from the stop 80. The hammer continues its acceleration in the forward direction and begins its ballistic flight, unimpeded by the print armature 70 (since the print armature is against the stop 108) into impact relationship with the printing element.

Figure 3D:
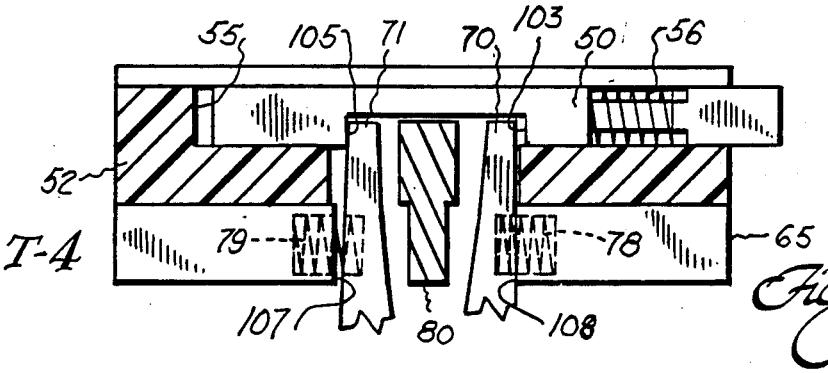

At time T4 which is shown in FIG. 3D, the printing element is being driven into the platen 11 and presses the ribbon 30 and the paper 12 against the platen to actually print the character. At this time the return armature 71 surface 105 contacts the hammer at the impact surface provided by the rear end wall 105 of the seat 7 and begins the driven flight of the hammer 50 towards the home position (the stop provided by the rear end surface 55). The hammer leaves the path of the printing element and the print band can move to the next character position.

Figure 3E:
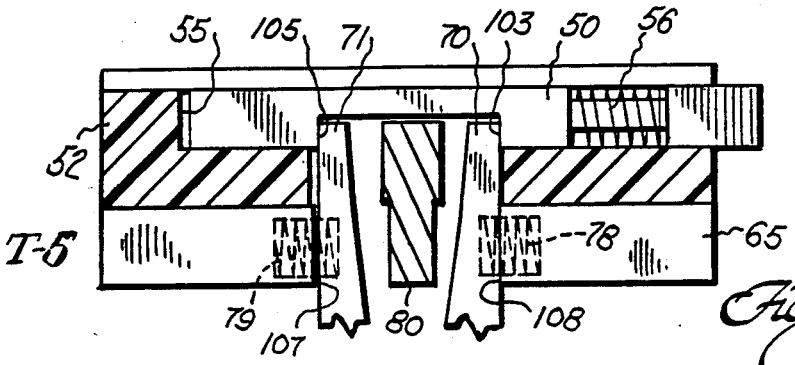

As shown in FIG. 3E after a further interval of time to T5 the forward end wall 103 of the slot 102 of the hammer 50 contacts the print armature 70, as the driving force continues to be applied at the surface 105 by the return armature 71. The current to the print coil 88 has at this time terminated so that the print armature 70 is rebounding under the bias of its return spring 78 toward the stop 80.

Figure 3F:
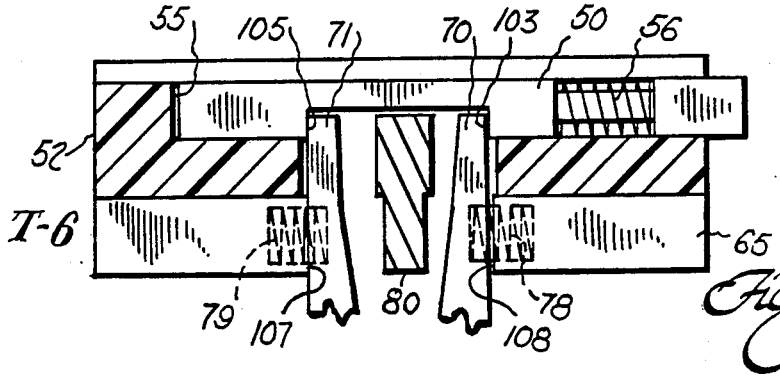

At time T6 and as shown in FIG. 3F the return armature has reached the stop surface 107. The hammer continues to the home position against the index surface provided by the rear end surface 55 of the slot 53. The flight of the hammer 50 is then ballistic, aided by the return spring 56. Any rebound of the hammer in the forward direction is arrested by the return armature 71.

Figure 3G:
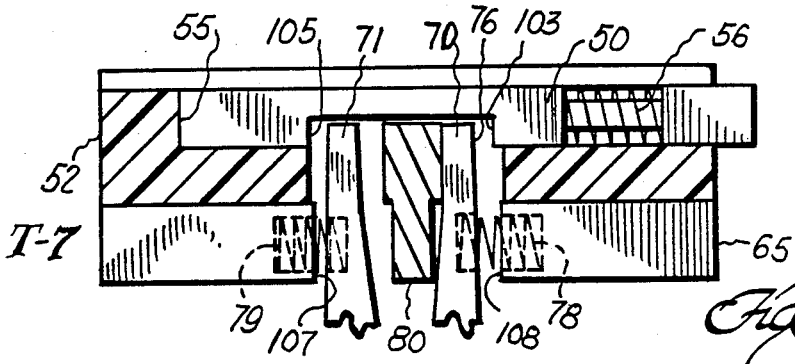
Figure 3H:
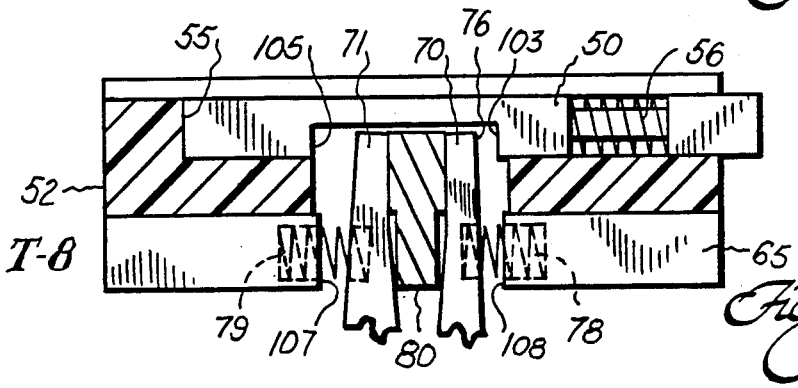

At time T7 which is shown in FIG. 3G the hammer 50 has reached the home position against index surface provided by the rear end surface 55. The return armature 71 starts to move towards the stop 80 under the bias of its return spring 79. The print armature 70 has already reached the stop 80.

At time T8 the hammer mechanism returns to the initial position which it occupied at time T0 and is ready for the next pair of print and return pulses.

The entire cycle in a typical print hammer mechanism may be performed within 8 milliseconds. The period of time during which the hammer is in the path of the printing element such that the printing element should be stationary is less than 2 milliseconds (i.e., from T3 to T5). The time intervals mentioned are exemplary and depend upon the mass of the elements, actuating currents and may increased or reduced to accommodate particular printer designs.

From the foregoing description it will be apparent that there has been provided an improved print hammer mechanism having features of high-speed of operation, reliability and controllability which improve printer performance. While an illustrative embodiment of the invention has been described, variations and modifications within the scope of the invention will certainly become apparent to those skilled in the art. Accordingly, the foregoing description should be taken as illustrative and not in a limiting sense.

We claim:

1. A print hammer mechanism comprising a print hammer moveable toward and away from a printing position, first and second armatures moveably disposed for engagement with said hammer, and means for mounting said first and second armatures in non-interfering relationship with said hammer until engagement therewith to drive said armatures toward and away from said printing position, said spacing being sufficient to enable said armatures to accelerate prior to contacting said hammer in impact delivering relationship and means for actuating said armatures into motion.

2. The mechanism according to claim 1 wherein said actuating means comprises first and second actuators respectively coupled to said first and second armatures.

3. The mechanism according to claim 1 wherein said actuating means comprises means for actuating said first and second armatures to move in timed relationship with each other so that said first armature drives said hammer in a forward direction to printing position and said second armature drives said hammer in a return direction away from printing position.

4. The mechanism according to claim 3 wherein said first and second actuators respectively comprise first and second electromagnets magnetically coupled to said first and second armatures, respectively.

5. The mechanism according to claim 1 wherein said mounting means comprises means biasing said armatures out of engagement with said hammer until actuated into motion by said actuating means and until said armatures each travel a predetermined distance over an open space before coming into contact with said hammer.

6. The mechanism according to claim 5 further comprising means biasing said hammer away from said printing position until engaged by said first armature.

7. A print hammer mechanism comprising a hammer moveable in forward and return directions, first and second armatures for moving said hammer in said forward and return directions, respectively, said hammer having a first surface opposed to said first armature and a second surface opposed to said second armature, said first and second surfaces respectively facing in different ones of said forward and return directions, means mounting said first armature for movement between first and second positions where said first armature is spaced from said first surface and where said first armature is in contact with said first surface, means mounting said second armature for movement between third and fourth positions where said second armature is spaced from said second surface and where said second armature is in contact with said second surface, said spacing being sufficient to enable said armatures to accelerate prior to contacting said hammer in impact delivering relationship, means for actuating said first and second armatures independently for impacting said hammer to drive it in the forward direction to printing position and then in the return direction after said hammer has reached the printing position.

8. The mechanism according to claim 7 wherein said hammer has a slot therein, said first and second surfaces being opposite ends of said slot.

9. The mechanism according to claim 8 wherein said armatures are members which extend into said slot, and means spaced from said slot pivotally mounting said armatures about separate pivot axes.

10. The mechanism according to claim 9 wherein said pivot axes are perpendicular to said forward and return directions and are spaced from said hammer.

11. The mechanism according to claim 10 further comprising a first stop between said armatures, and means for biasing said armatures against said stop.

12. The mechanism according to claim 11 wherein said first stop has opposite sides defining said first and third positions and second and third stops opposite to different ones of said opposite sides of said first stop and defining said second and fourth positions.

13. The mechanism according to claim 12 further comprising means for biasing said in hammer in said return direction and means defining a path of travel of said hammer in said forward and return directions and having a forth stop at the rear end thereof against which said hammer is indexed by said return direction biasing means, said forth stop being disposed with respect to said first stop so that said armature members are disposed within said slot when in contact with said first stop and are spaced said first and second surface.

14. The mechanism according to claim 7 wherein said armatures have a mass greater than the mass of said hammers.

15. The mechanism according to claim 7 wherein a plurality of said hammers are provided, means mounting said hammers spaced from each other in side-by-side relationship, a plurality of said first and second armatures disposed in side-by-side relationship, each of said hammers having a width in the direction which said hammers are spaced from each other, said width being narrower than the width of said armatures in said last name direction.

16. The mechanism according to claim 15 wherein said plurality of hammers and said mounting means comprise an assembly moveable in a direction transverse to said forward and return direction.

17. The mechanism according to claim 7 wherein said actuating means comprises a magnetic structure presenting magnetic poles opposite to said first and second armatures, and coils magnetically coupled to said structure for selectively applying magnetic forces for actuating said armatures.

18. The mechanism according to claim 17 further comprising means pivotally mounting said armatures on said magnetic structure.

19. In a printer having printing elements for printing by impact of the elements against a record medium and having a print hammer mechanism including at least one print hammer for impacting upon the printing elements, an improved actuator for said print hammer comprising a pair of armatures normally spaced from and moveable into contact with said hammer for driving said hammer in forward and return directions against and away from said print elements, said spacing being sufficient to enable said armatures to accelerate prior to contacting said hammer in impact delivering relationship and means for independently actuating said armatures.

20. The improvement according to claim 19 wherein said armatures are levers pivotally mounted for movement in opposite directions when actuated by said actuating means, each lever having a surface engagable with said hammer and spaced therefrom until moved into contact with said hammer.

* * * * *